US005705085A

United States Patent [19]

Munoz et al.

[11] Patent Number: 5,705,085

[45] Date of Patent: Jan. 6, 1998

[54] ORGANOMOLYBDENUM-CONTAINING MAGNETORHEOLOGICAL FLUID

[75] Inventors: Beth C. Munoz, Apex, N.C.; Anthony J. Margida, Scandia, Minn.; Thomas J. Karol, Norwalk, Conn.

[73] Assignee: Lord Corporation, Cary, N.C.

[21] Appl. No.: 664,075

[22] Filed: Jun. 13, 1996

[51] Int. Cl.[6] ..... H01F 1/28

[52] U.S. Cl. ..... 252/62.52; 252/62.54

[58] Field of Search ..... 252/62.52, 62.54

[56] References Cited

U.S. PATENT DOCUMENTS

| | | | |
|---|---|---|---|
| 2,751,352 | 6/1956 | Bondi | 252/62.5 |
| 2,805,996 | 9/1957 | Benoit et al. | 252/42.7 |
| 2,886,151 | 5/1959 | Winslow | 192/21.5 |
| 4,164,473 | 8/1979 | Coupland et al. | 252/32.7 E |
| 4,356,098 | 10/1982 | Chagnon | 252/62.51 |
| 4,889,647 | 12/1989 | Rowan et al. | 252/42.7 |
| 4,990,271 | 2/1991 | Francis | 252/33.6 |
| 5,094,769 | 3/1992 | Anderson, Jr. et al. | 252/71 |
| 5,137,647 | 8/1992 | Karol | 252/33.6 |
| 5,143,637 | 9/1992 | Yokouchi et al. | 252/62.52 |
| 5,147,573 | 9/1992 | Chagnon | 252/62.52 |
| 5,213,704 | 5/1993 | Anderson, Jr. et al. | 252/75 |
| 5,271,858 | 12/1993 | Clough et al. | 252/74 |
| 5,326,633 | 7/1994 | Clough et al. | 428/288 |
| 5,354,488 | 10/1994 | Shtarkman et al. | 252/62.56 |
| 5,382,373 | 1/1995 | Carlson et al. | 252/62.55 |
| 5,412,130 | 5/1995 | Karol | 556/57 |

FOREIGN PATENT DOCUMENTS

| | | |
|---|---|---|
| 52-77981 | 12/1975 | Japan . |
| 62195729 | 8/1986 | Japan . |
| WO 94/10692 | 5/1994 | WIPO . |
| WO 94/10693 | 5/1994 | WIPO . |
| WO 94/10694 | 5/1994 | WIPO . |

OTHER PUBLICATIONS

"Vanderbilt Lubricant Additives", R.T. Vanderbilt Company, Inc., Technical Bulletin 941.

*Primary Examiner*—Melissa Bonner

*Attorney, Agent, or Firm*—Wayne W. Rupert; Randall S. Wayland; James W. Wright

[57] ABSTRACT

A magnetorheological fluid that includes magnetic-responsive particles, a carrier fluid and an organomolybdenum. The organomolybdenum preferably includes at least one molybdenum atom bonded to at least one organic moiety wherein the organic moiety can be derived from a precursor selected from the group consisting of a saturated or unsaturated hydrocarbon, an aromatic hydrocarbon, an oxygen-containing compound, a nitrogen-containing compound and a compound containing more than one functional group.

21 Claims, No Drawings

ORGANOMOLYBDENUM-CONTAINING MAGNETORHEOLOGICAL FLUID

BACKGROUND AND SUMMARY OF THE INVENTION

This invention relates to fluids that exhibit substantial increases in flow resistance when exposed to magnetic fields.

Fluid compositions that undergo a change in apparent viscosity in the presence of a magnetic field are commonly referred to as Bingham magnetic fluids or magnetorheological fluids. Magnetorheological fluids typically include magnetic-responsive particles dispersed or suspended in a carrier fluid. In the presence of a magnetic field, the magnetic-responsive particles become polarized and are thereby organized into chains of particles or particle fibrils within the carrier fluid. The chains of particles act to increase the apparent viscosity or flow resistance of the overall materials resulting in the development of a solid mass having a yield stress that must be exceeded to induce onset of flow of the magnetorheological fluid. The force required to exceed the yield stress is referred to as the "yield strength". In the absence of a magnetic field, the particles return to an unorganized or free state and the apparent viscosity or flow resistance of the overall materials is correspondingly reduced. Such absence of a magnetic field is referred to herein as the "off-state".

Magnetorheological fluids are useful in devices or systems for controlling vibration and/or noise. For example, magnetorheological fluids are useful in providing controllable forces acting upon a piston in linear devices such as dampers, mounts and similar devices. Magnetorheological fluids are also useful for providing controllable torque acting upon a rotor in rotary devices. Possible linear or rotary devices could be clutches, brakes, valves, dampers, mounts and similar devices. In these applications magnetorheological fluid can be subjected to shear forces, as high as 70 kPa, often significantly high, and shear rates in the order of 20,000 to 50,000 $sec^{-1}$ causing extreme wear on the magnetic-responsive particles. As a result, the magnetorheological fluid thickens substantially over time leading to increasing off-state viscosity. The increasing off-state viscosity leads to an increase in off-state force experienced by the piston or rotor. This increase in off-state force hampers the freedom of movement of the piston or rotor at off-state conditions. In addition, it is desirable to maximize the ratio of on-state force to off-state force in order to maximize the controllability offered by the device. Since the on-state force is dependent upon the magnitude of the applied magnetic field, the on-state force should remain constant at any given applied magnetic Held. If the off-state force increases over time because the off-state viscosity is increasing but the on-state force remains constant, the on-state/off-state ratio will decrease. This on-state/off-state ratio decrease results in undesirable minimization of the controllability offered by the device. A more durable magnetorheological fluid that does not thicken over an extended period of time, preferably over the life of the device that includes the fluid, would be very useful.

Magnetorheological fluids are described, for example, in U.S. Pat. No. 5,382,373 and published PCT International Patent Applications WO 94/10692, WO 94/10693 and WO 94/10694.

WO 94/10694 relates to a magnetorheological fluid that includes magnetic particles in a carrier fluid wherein the magnetic particles have been provided with a protective coating that substantially encapsulates the particles. Possible coating materials are said to include nonmagnetic metals, ceramics, high performance thermoplastics, and thermosetting polymers.

U.S. Pat. No. 4,356,098 relates to a colloidal suspension of particles having a particle size of, at most, 800 Angstroms that includes a silicone oil carrier fluid and a silicone oil-type surfactant. Although the patent is directed to ferrofluids, one passage mentions that the system could be used to provide a stable composition of nonmagnetic colloidal particles. Oxides and sulfides of molybdenum are included in the list of possible nonmagnetic colloidal particles.

U.S. Pat. No. 4,889,647 relates to an organomolybdenum complex that is prepared by reacting a fatty oil having 12 or more carbon atoms, diethanolamine and a molybdenum source. This organomolybdenum complex is said to be useful as a component in lubricating compositions for use in internal combustion engines.

U.S. Pat. No. 5,412,130 relates to a process for preparing 2,4-heteroatom substituted-molybdena-3,3-dioxacycloalkane compounds. There is no mention of any use for the molybdate compounds.

U.S. Pat. No. 5,271,858 and U.S. Pat. No. 5,326,633 relate to an electrorheological fluid that includes a carbon, glass, silicate, or ceramic particulate having an electrically conductive tin dioxide coating.

U.S. Pat. No. 5,147,573 relates to a ferrofiuid that includes superparamagnetic particles having a maximum average particle size of 500 angstroms, an electrically conductive surface active agent adsorbed as a conductive shell around the superparamagnetic particles, a dispersing or suspending agent and a carrier fluid. The electrically conductive surface active agent can be an alkyl or alkoxide organometallic compound. The listed possibilities for the metal portion of the organometallics are titanium, antimony, tin, hafnium and zirconium.

U.S. Pat. No. 5,354,488 relates to an electrorheological magnetic fluid that includes magnetizable particles, a carrier fluid and a dispersant that consists of particles having no dimensions greater than 10 nm. The dispersant particles may be made of single element metals or non-metal substances such as carbon, boron, aluminum, non-magnetizable iron, germanium and silicon or inorganic compounds like metal carbides, oxides, nitrides and other salts of aluminum, boron, germanium, hafnium, iron, silicon, tantalum, titanium, tungsten, yttrium and zirconium.

JP-A-52-77981 relates to a dispersion of superparamagnetic colloidal in water or petroleum that includes 5 to 30 volume percent of a molybdenum or tungsten powder having particle diameters ranging from 0.1 to 10 μm. The dispersion is used for sealing rotary shafts which is a well known use for ferrofiuids.

SUMMARY OF THE INVENTION

The invention is a magnetorheological fluid that includes magnetic-responsive particles, a carrier fluid and at least one organomolybdenum additive.

The magnetorheological fluid of the invention exhibits superior durability because of a substantial decrease in the thickening of the fluid over a period of use.

There also is provided according to the invention a magnetorheological damper that include a housing that contains the above-described magnetorheological fluid.

DETAILED DESCRIPTION OF THE PREFERRED EMBODIMENTS

The organomolybdenum component can be a compound or complex whose structure includes at least one molybdenum atom bonded to or coordinated with at least one organic moiety. The organic moiety can be, for example, derived from a saturated or unsaturated hydrocarbon such as alkane, alkene, alkadiene or cycloalkane; an aromatic hydrocarbon such as phenol or thiophenol; an oxygen-containing compound such as carboxylic acid or anhydride, ester, ether, peroxide or alcohol; a nitrogen-containing compound such as amidine, amine or imine; or a compound containing more than one functional group such as thiocarboxylic acid, imidic acid, thiol, amide, imide, alkoxy or hydroxy amine, and amino-thiol-alcohol. The precursor for the organic moiety can be a monomeric compound, an oligomer or polymer. A heteroatom such as =O, —S or —N also can be bonded to or coordinated with the molybdenum atom in addition to the organic moiety.

A particularly preferred group of organomolybdenums is described in U.S. Pat. No. 4,889,647 and U.S. Pat. No. 5,412,130, both incorporated herein by reference. U.S. Pat. No. 4,889,647 describes an organomolybdenum complex that is prepared by reacting a fatty oil, diethanolamine and a molybdenum source. U.S. Pat. No. 5,412,130 describes heterocyclic organomolybdates that are prepared by reacting diol, diamino-thiol-alcohol and amino-alcohol compounds with a molybdenum source in the presence of a phase transfer agent. An organomolybdenum that is prepared according to U.S. Pat. No. 4,889,647 and U.S. Pat. No. 5,412,130 is available from R.T. Vanderbilt Inc. under the tradename Molyvan® 855.

Organomolybdenums that also might be useful are described in U.S. Pat. No. 5,137,647 which describes an organomolybdenum that is prepared by reacting an amine-amide with a molybdenum source; U.S. Pat. No. 4,990,271 which describes a molybdenum hexacarbonyl dixanthogen; U.S. Pat. No. 4,164,473 which describes an organomolybdenum that is prepared by reacting a hydrocarbyl substituted hydroxy alkylated amine with a molybdenum source; and U.S. Pat. No. 2,805,997 which describes alkyl esters of molybdic acid.

The organomolybdenum component that is added to the magnetorheological fluid preferably is in a liquid state at ambient room temperature and does not contain any particles above molecular size.

The organomolybdenum can be present in an amount of 0.1 to 12, preferably 0.25 to 10, volume percent, based on the total volume of the magnetorheological fluid.

Especially durable magnetorheological fluids can be obtained if the organomolybdenum component is present in combination with a second additive. The second additive can be present in an amount of 0.25 to 12, preferably 0.5 to 10, volume percent, based on the total volume of the magnetorheological fluid.

Useful second additives include phosphates and sulfur-containing compounds. Examples of phosphates include alkyl, aryl, alkylaryl, arylalkyl, amine and alkyl amine phosphates. Illustrative of such phosphates are tricresyl phosphate, trixylenyl phosphate, dilauryl phosphate, octadecyl phosphate, hexadecyl phosphate, dodecyl phosphate and didodecyl phosphate. A particularly preferred alkyl amine phosphate is available from R.T. Vanderbilt Inc. under the tradename Vanlube® 9123. Examples of sulfur-containing compounds include thioesters such as tetrakis thioglycolate, tetrakis(3-mercaptopropionyl) pentaerithritol, ethylene glycoldimercaptoacetate, 1,2,6-hexanetriol trithioglycolate, trimethylol ethane tri(3-mercaptopropionate), glycoldimercaptopropionate, bisthioglycolate, trimethylolethane trithioglycolate, trimethylolpropane tris(3-mercaptopropionate) and similar compounds and thiols such as 1-dodecylthiol, 1-decanethiol, 1-methyl-1-decanethiol, 2-methyl-2-decanethiol, 1-hexadecylthiol, 2-propyl-2-decanethiol, 1-butylthiol, 2-hexadecylthiol and similar compounds.

The magnetic-responsive particle component of the magnetorheological material of the invention can be comprised of essentially any solid which is known to exhibit magnetorheological activity. Typical magnetic-responsive particle components useful in the present invention are comprised of, for example, paramagnetic, superparamagnetic or ferromagnetic compounds. Superparamagnetic compounds are especially preferred. Specific examples of magnetic-responsive particle components include particles comprised of materials such as iron, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide include ferrites and magnetites. In addition, the magnetic-responsive particle component can be comprised of any of the known alloys of iron, such as those containing aluminum, silicon, cobalt, nickel, vanadium, molybdenum, chromium, tungsten, manganese and/or copper.

The magnetic-responsive particle component can also be comprised of the specific iron-cobalt and iron-nickel alloys described in U.S. Pat. No. 5,382,373. The iron-cobalt alloys useful in the invention have an iron:cobalt ratio ranging from about 30:70 to 95:5, preferably ranging from about 50:50 to 85:15, while the iron-nickel alloys have an iron-:nickel ratio ranging from about 90:10 to 99:1, preferably ranging from about 94:6 to 97:3. The iron alloys may contain a small amount of other elements, such as vanadium, chromium, etc., in order to improve the ductility and mechanical properties of the alloys. These offer elements are typically present in an amount that is less than about 3.0% by weight. Due to their ability to generate somewhat higher yield stresses, the iron-cobalt alloys are presently preferred over the iron-nickel alloys for utilization as the particle component in a magnetorheological material. Examples of the preferred iron-cobalt alloys can be commercially obtained under the tradenames HYPERCO (Carpenter Technology), HYPERM (F. Krupp Widiafabrik), SUPERMENDUR (Arnold Eng.) and 2V-PERMENDUR (Western Electric).

The magnetic-responsive particle component of the invention is typically in the form of a metal powder which can be prepared by processes well known to those skilled in the art. Typical methods for the preparation of metal powders include the reduction of metal oxides, grinding or attrition, electrolytic deposition, metal carbonyl decomposition, rapid solidification, or smelt processing. Various metal powders that are commercially available include straight iron powders, reduced iron powders, insulated reduced iron powders, cobalt powders, and various alloy powders such as [48%]Fe/[50%]Co/[2%]V powder available from UltraFine Powder Technologies.

The preferred magnetic-responsive particles are those that contain a majority amount of iron in some form. Carbonyl iron powders that are high purity iron particles made by the thermal decomposition of iron pentacarbonyl are particularly preferred. Carbonyl iron of the preferred form is commercially available from ISP Technologies, GAF Corporation and BASF Corporation.

The particle size should be selected so that it exhibits multi-domain characteristics when subjected to a magnetic field. The magnetic-responsive particles should have an average particle size distribution of at least about 0.1 μm, preferably at least about 1 μm. The average particle size distribution should range from about 0.1 to about 500 μm, with from about 1 to about 500 μm being preferred, about 1 to about 250 μm being particularly preferred, and from about 1 to about 100 μm being especially preferred.

The amount of magnetic-responsive particles in the magnetorheological fluid depends upon the desired magnetic activity and viscosity of the fluid, but should be from about 5 to about 50, preferably from about 15 to 40, percent by volume based on the total volume of the magnetorheological fluid.

The carrier component is a fluid that forms the continuous phase of the magnetorheological fluid. Suitable carrier fluids may be found to exist in any of the classes of oils or liquids known to be carrier fluids for magnetorheological fluids such as natural fatty oils, mineral oils, polyphenylethers, dibasic acid esters, neopentylpolyol esters, phosphate esters, polyesters (such as perfluorinated polyesters), synthetic cycloparaffin oils and synthetic paraffin oils, unsaturated hydrocarbon oils, monobasic acid esters, glycol esters and ethers, synthetic hydrocarbon oils, perfluorinated polyethers and halogenated hydrocarbons, as well as mixtures and derivatives thereof. The carrier component may be a mixture of any of these classes of fluids. The preferred carrier component is non-volatile, non-polar and does not include any significant amount of water. The carrier component (and thus the magnetorheological fluid) particularly preferably should not include any volatile solvents commonly used in lacquers or compositions that are coated onto a surface and then dried such as toluene, cyclohexanone, methyl ethyl ketone, methyl isobutyl ketone and acetone. Descriptions of suitable carrier fluids can be found, for example, in U.S. Pat. No. 2,751,352 and U.S. Pat. No. 5,382,373, both hereby incorporated by reference. Hydrocarbons, such as mineral oils, paraffins, cycloparaffins (also known as naphthenic oils) and synthetic hydrocarbons are the preferred classes of carrier fluids. The synthetic hydrocarbon oils include those oils derived from oligomerization of olefins such as polybutenes and oils derived from high alpha olefins of from 8 to 20 carbon atoms by acid catalyzed dimerization and by oligomerization using trialuminum alkyls as catalysts. Poly-α-olefin is a particularly preferred carrier fluid. Carrier fluids appropriate to the present invention may be prepared by methods well known in the art and many are commercially available.

The carrier fluid of the present invention is typically utilized in an amount ranging from about 50 to 95, preferably from about 60 to 85, percent by volume of the total magnetorheological fluid.

The magnetorheological fluid can optionally include other additives such as a thixotropic agent, a carboxylate soap, an antioxidant, a lubricant and a viscosity modifier. If present, the amount of these optional additives typically ranges from about 0.25 to about 10, preferably about 0.5 to about 7.5, volume percent based on the total volume of the magnetorheological fluid.

Useful thixotropic agents are described, for example, in WO 94/10693 and commonly-assigned U.S. patent application Ser. No. 08/575,240, incorporated herein by reference. Such thixotropic agents include polymer-modified metal oxides. The polymer-modified metal oxide can be prepared by reacting a metal oxide powder with a polymeric compound that is compatible with the carrier fluid and capable of shielding substantially all of the hydrogen-bonding sites or groups on the surface of the metal oxide from any interaction with other molecules. Illustrative metal oxide powders include precipitated silica gel, fumed or pyrogenic silica, silica gel, titanium dioxide, and iron oxides such as ferrites or magnetites. Examples of polymeric compounds useful in forming the polymer-modified metal oxides include siloxane oligomers, mineral oils and paraffin oils, with siloxane oligomers being preferred. The metal oxide powder may be surface-treated with the polymeric compound through techniques well known to those skilled in the art of surface chemistry. A polymer-modified metal oxide, in the form of fumed silica treated with a siloxane oligomer, can be commercially obtained under the trade names AEROSIL R-202 and CABOSIL TS-720 from DeGussa Corporation and Cabot Corporation, respectively.

Examples of the carboxylate soap include lithium stearate, calcium stearate, aluminum stearate, ferrous oleate, ferrous naphthenate, zinc stearate, sodium stearate, strontium stearate and mixtures thereof.

The viscosity of the magnetorheological fluid is dependent upon the specific use of the magnetorheological fluid. In the instance of a magnetorheological fluid that is used with a damper the carrier fluid should have a viscosity of 6 to 500, preferably 15 to 395, Pa-sec measured at 40° C. in the off-state.

The magnetorheological fluid can be used in any controllable device such as dampers, mounts, clutches, brakes, valves and similar devices. These magnetorheological devices include a housing or chamber that contains the magnetorheological fluid. Such devices are known and are described, for example, in U.S. Pat. No. 5,277,281; U.S. Pat. No. 5,284,330; U.S. Pat. No. 5,398,917; U.S. Pat. Nos. 5,492,312; 5,176,368; 5,257,681; 5,353,839; and 5,460,585, all incorporated herein by reference, and PCT published patent application WO 96/07836. The fluid is particularly suitable for use in devices that require exceptional durability such as dampers. As used herein, "damper" means an apparatus for damping motion between two relatively movable members. Dampers include, but are not limited to, shock absorbers such as automotive shock absorbers. The magnetorheological dampers described in U.S. Pat. No. 5,277,281 and U.S. Pat. No. 5,284,330, both incorporated herein by reference, are illustrative of magnetorheological dampers that could use the magnetorheological fluid.

Examples of the magnetorheological fluid were prepared as follows: A synthetic hydrocarbon oil derived from poly-α-olefin (available from Albemarle Corp. under the tradename DURASYN 164) was homogeneously mixed with the organomolybdenum additive and, in Fluids 2 and 3 with a second additive, in the amounts shown in Table 1. To this homogeneous mixture, carbonyl iron (available from GAF Corp. under the tradename R2430) in the amount shown in Table 1 was added while continuing mixing. Fumed silica (available from Cabot Corp. under the tradename CAB-O-SIL TS-720) in the amount shown in Table 1 was then added while continuing mixing. The full formulation then was mixed while cooling with an ice bath to maintain the temperature near ambient. Table 1 shows the composition of the fluids prepared with all quantities in volume percent based on the total volume of the final fluid. In Fluid 3 a parafin/naphthenic oil (available from Penreco Corp. under the trademark DRAKEOL 10B) was used instead of DURASYN 164.

TABLE 1

| Sample | Iron | Silica | Poly-α olefin | Organo-molybdenum Molyvan 855 | Amine-akylphosphate Vanlube 9123 |
|---|---|---|---|---|---|
| Fluid 1 | 25 | 1.8 | 70.2 | 3.0 | 0 |
| Fluid 2 | 25 | 1.8 | 70.2 | 1.5 | 1.5 |
| Fluid 3 | 25 | 1.8 | 70.2 | 1.5 | 1.5 |

What is claimed is:

1. A magnetorheological fluid comprising magnetic-responsive particles, a carrier fluid and at least one organomolybdenum.

2. A magnetorheological fluid according to claim 1, wherein the organomolybdenum comprises at least one molybdenum atom bonded to at least one organic moiety.

3. A magnetorheological fluid according to claim 2, wherein the organic moiety is derived from a precursor selected from the group consisting of a saturated or unsaturated hydrocarbon, an aromatic hydrocarbon, an oxygen-containing compound, a nitrogen-containing compound and a compound containing more than one functional group.

4. A magnetorheological fluid according to claim 2, wherein the organomolybdenum is selected from the group consisting of an organomolybdenum complex prepared by reacting a fatty oil, diethanolamine and a molybdenum source; a heterocyclic molybdenum prepared by reacting a diol, a diamino-thiol-alcohol, an amino-alcohol and a molybdenum source; and an organomolybdenum prepared by reacting an amine-amide with a molybdenum source.

5. A magnetorheological fluid according to claim 1, wherein the organomolybdenum is present in amount of 0.1 to 12 volume percent, based on the total volume of the magnetorheological fluid.

6. A magnetorheological fluid according to claim 1, wherein the magnetic-responsive particles have an average particle size of 0.1 to 500 μm.

7. A magnetorheological fluid according to claim 1, wherein the magnetic-responsive particles have an average particle size of at least 1 μm.

8. A magnetorheological fluid according to claim 1, wherein the carrier fluid comprises at least one fluid selected from the group consisting of natural fatty oil, mineral oil, polyphenylether, dibasic acid ester, neopentylpolyol ester, phosphate ester, polyester, cycloparaffin oil, paraffin oil, unsaturated hydrocarbon oil, synthetic hydrocarbon oil, monobasic acid ester, glycol ester, glycol ether, perfluorinated polyether and halogenated hydrocarbon.

9. A magnetorheological fluid according to claim 8, wherein the carrier fluid is selected from the group consisting of mineral oil, paraffin, cycloparaffin, naphthenic oil and synthetic hydrocarbon.

10. A magnetorheological fluid according to claim 9, wherein the carrier fluid comprises a synthetic hydrocarbon derived from polyalphaolefin.

11. A magnetorheological fluid according to claim 1, wherein the magnetic-responsive particles have an average particle size of 0.1 to 500 μm, the carrier fluid is selected from the group consisting of mineral oil, paraffin, cycloparaffin, naphthenic oil and synthetic hydrocarbon, and the organomolybdenum comprises at least one molybdenum atom bonded to at least one organic moiety, wherein the organic moiety is derived from a precursor selected from the group consisting of a saturated or unsaturated hydrocarbon, an aromatic hydrocarbon, an oxygen-containing compound, a nitrogen-containing compound and a compound containing more than one functional group.

12. A magnetorheological fluid according to claim 1, further comprising at least one second additive.

13. A magnetorheological fluid according to claim 12, wherein the second additive is selected from the group consisting of a phosphate and a sulfur-containing compound.

14. A magnetorheological fluid according to claim 13, wherein the phosphate is selected from the group consisting of alkyl, aryl, alkylaryl, arylalkyl, amine and alkyl amine phosphate.

15. A magnetorheological fluid according to claim 13, wherein the phosphate is selected from the group consisting of tricresyl phosphate, trixylenyl phosphate, dilauryl phosphate, octadecyl phosphate, hexadecyl phosphate, dodecyl phosphate, didodecyl phosphate, and an alkyl amine phosphate.

16. A magnetorheological fluid according to claim 12, wherein the sulfur-containing compound is selected from the group consisting of thiol and thioester.

17. A magnetorheological fluid according to claim 12, wherein the second additive is present in amount of 0.1 to 12 volume percent, based on the total volume of the magnetorheological fluid.

18. A magnetorheological fluid according to claim 1, further comprising at least one carboxylate soap.

19. A magnetorheological fluid according to claim 1, further comprising a polymer-modified metal oxide.

20. A magnetorheological fluid according to claim 1, further comprising a phosphate, a carboxylate soap and a polymer-modified metal oxide.

21. A magnetorheological fluid according to claim 18 wherein the carboxylate soap is selected from the group consisting of lithium stearate, calcium stearate, aluminum stearate, ferrous oleate, ferrous naphthenate, zinc stearate, sodium stearate and strontium stearate.

* * * * *